US007455583B2

(12) United States Patent
Taya

(10) Patent No.: US 7,455,583 B2
(45) Date of Patent: Nov. 25, 2008

(54) VENTILATOR INCLUDING A CONTROL UNIT AND HUMAN SENSOR

(75) Inventor: Hitoshi Taya, Aichi (JP)

(73) Assignee: Panasonic Corporation, Osaka (JP)

( * ) Notice: Subject to any disclaimer, the term of this patent is extended or adjusted under 35 U.S.C. 154(b) by 170 days.

(21) Appl. No.: 11/242,128

(22) Filed: Oct. 4, 2005

(65) Prior Publication Data

US 2007/0074725 A1 Apr. 5, 2007

(51) Int. Cl.
*F24F 7/007* (2006.01)
*F24F 11/02* (2006.01)

(52) U.S. Cl. ..... 454/256; 454/229; 454/343; 454/354

(58) Field of Classification Search ..... 454/229, 454/256, 339, 343, 354; 340/309.9
See application file for complete search history.

(56) References Cited

U.S. PATENT DOCUMENTS

| | | | | |
|---|---|---|---|---|
| 2,619,021 | A * | 11/1952 | Pfautsch | 454/292 |
| 5,309,146 | A * | 5/1994 | Kenet | 340/540 |
| 5,862,981 | A * | 1/1999 | Weng | 236/46 R |
| 5,910,045 | A * | 6/1999 | Aoki et al. | 454/186 |
| 6,079,626 | A * | 6/2000 | Hartman | 236/13 |
| 2003/0211820 | A1 * | 11/2003 | Tsuji et al. | 454/93 |

FOREIGN PATENT DOCUMENTS

| | | | |
|---|---|---|---|
| JP | 61213542 | A * | 9/1986 |
| JP | 62242743 | A * | 10/1987 |
| JP | 63129232 | A * | 6/1988 |
| JP | 02075798 | A * | 3/1990 |
| JP | 02251036 | A * | 10/1990 |
| JP | 06249477 | A * | 9/1994 |
| JP | 09-079623 | | 3/1997 |

OTHER PUBLICATIONS

Attached English translation of Japanese Patent No. 09-079623 (machine-generated).*

* cited by examiner

*Primary Examiner*—Steven B McAllister
*Assistant Examiner*—Patrick F. O'Reilly, III
(74) *Attorney, Agent, or Firm*—McDermott Will & Emery LLP

(57) ABSTRACT

The invention presents a ventilator capable of obtaining an optimum flow rate required in ordinary ventilation. The ventilator comprises an exhaust fan motor for exhausting room air by force, and a human sensor for detecting the presence of human body. It further comprises a control unit for controlling the fan motor by receiving a signal from the human sensor, and a flow rate adjusting unit for adjusting the ventilation flow rate by the exhaust fan motor. The control unit, when detecting a signal from the human sensor, operates the exhaust fan motor for a specified time at fixed flow rate, and while not detecting, it operates the exhaust fan motor all the time at ventilated flow rate adjusted by the flow rate adjusting unit. During this ordinary operation, the flow rate may be adjusted by the flow rate adjusting unit either steplessly or in multiple steps at small intervals, and thereby a ventilator capable of obtaining an optimum flow rate required in ordinary ventilation can be presented.

6 Claims, 5 Drawing Sheets

VENTILATOR INCLUDING A CONTROL UNIT AND HUMAN SENSOR

TECHNICAL FIELD

The present invention relates to a ventilator for ventilating in order to exhaust moisture and odor generated by human behavior in living spaces especially bathroom and toilet.

BACKGROUND ART

This kind of ventilator is usually installed by calculating the ventilation rate from the specified number of times of ventilation, structure of house, and room space at the time of designing a house, and determining the model of ventilating apparatus in consideration of duct length and other conditions of installation work. In actual installation works, it is often required to adjust the air flow rate by inspecting the calculated air flow rate and actual air flow rate after installation. Accordingly, the ventilator main body is provided with an air flow rate adjusting unit capable of adjusting the air flow rate in two steps, such as flow rate 1 and flow rate 2, and the air flow rate is adjusted appropriately.

FIG. 6 is a schematic wiring diagram of a conventional ventilator. A ventilator main body 101 comprises a fan motor 102, a human sensor 103, an air flow rate adjusting unit 104 for changing over the air flow rate of the fan motor 102, for example, between 100% (flow rate 1) and 70% (flow rate 2) of the maximum air flow rate, and a control unit 105 for controlling power feed to the fan motor 102. Aside from the ventilator main body 101, a wall switch 106 is installed separately. The wall switch 106 includes a power switch 106*a* for turning on and off the power source, and a mode switch 106*b* for changing, over between automatic operation mode for controlling the fan motor 102 by the human sensor 103 and continuous operation mode for operating at specified flow rate. The builder of the installation work sets at flow rate 1 or flow rate 2 by the air flow rate adjusting unit 104 so as to adjust to specified flow rate after installation of the ventilator.

FIG. 7 is an operation flowchart of automatic operation of ventilator in FIG. 6. When the user sets the wall switch 106 in automatic operation, depending on the signal of the human sensor 103, the control unit 105 stops operation when the human sensor 103 does not detect presence of human body. Receiving a signal from the human sensor 103, human sensing operation or delay operation for specified time is conducted at flow rate 1 or flow rate 2.

The delay operation is intended to exhaust the moisture in the bathroom or odor in the toilet by force after the user leaves the room.

In another conventional ventilator, in the midst of ordinary ventilating operation, the ventilation flow rate is varied on the basis of detection by environmental detection sensor or the like, and the operation returns to ordinary ventilating operation when the environmental detection sensor no longer detects anything (see, for example, Japanese Patent Laid-Open Publication 9-79623).

In such ventilator, when adjusting the ventilator determined from the calculated flow rate and the actual flow rate after installation, the flow rate of fan motor is adjusted, for example, in two steps, and the adjusting interval is wide, and the flow rate may be set more than necessary, and excessive power may be wasted.

Meanwhile, when an alternating-current induction motor is used as fan motor, since the torque is small, it is hard to hold at low flow rate, and it is likely to have effects of static pressure by duct or the like. Or when strongly recommending ventilation all the time in order to keep ventilation passage by the ventilator, since the user can turn off the power feed by manipulating the wall switch, the ventilation passage may be easily closed. While bathing in the bathroom, if ventilated by force at large flow rate, cold draft may be felt by the fan motor for exhaust. Cold draft is feeling of uncomfortable coldness by the user in the bathroom due to invading air by ventilation or air stream caused by ventilation. If low flow rate operation during bathing in the bathroom is continued after the user leaves the bathroom, it takes a very long time in operation for exhausting moisture components absorbed in the building materials after use of bathroom.

DISCLOSURE OF THE INVENTION

The ventilator of the invention comprises an exhaust fan motor for ventilating room air, a human sensor for detecting the presence of human body, a control unit for controlling the exhaust fan motor by receiving a signal from the human sensor, and an air flow rate adjusting unit for adjusting the ventilation flow rate by the exhaust fan motor. The control unit operates the ventilation fan motor at a fixed flow rate for a specified time when detecting a signal from the human sensor, and operates the ventilation fan motor at a ventilation flow rate adjusted by the flow rate adjusting unit all the time when not detecting. In ordinary operation, the ventilation flow rate can be adjusted steplessly or in multiple steps at small intervals by the flow rate adjusting unit.

Accordingly, a desired ordinary ventilation flow rate can be securely assured. For example, when the calculated flow rate determined from the room space and duct length is 60 cubic meters per hour, if the maximum flow rate of the exhaust fan motor is 100 cubic meters per hour, the flow rate is set at 60% by the flow rate adjusting unit, and the flow rate can be increased or decreased and adjusted by manipulating the flow rate adjusting unit when inspecting the flow rate after installation, so that desired ordinary ventilation flow rate can be obtained.

In the ventilator of the invention, the fixed flow rate operated by the signal from the human sensor is the maximum flow rate of the exhaust fan motor. It is hence possible to ventilate quickly in a short time.

In the ventilator of the invention, the exhaust fan motor is a direct-current motor. If the exhaust fan motor is an alternating-current motor, the flow rate can be generally lowered only to 70% of the maximum flow rate, but by using a direct-current motor, the flow rate can be lowered to about 30%. Hence, the low flow rate portion of exhaust fan motor can be controlled widely to 30 cubic meters, and power consumption can be saved while it is less likely to have effects of static pressure.

The ventilator of the invention has a wall switch built in the wall, and power switch is not disposed in the wall switch, but it has a selector 7*a* for selecting between automatic operation mode for automatically changing the ventilation flow rate by detection of the human sensor, and continuous operation mode for operating the exhaust fan motor continuously by force at specified ventilation flow rate. Either operation mode can be selected, and power on/off operation is not needed. Hence the exhaust fan motor is always operated in either mode, and the user can select by the wall switch either automatic operation mode by the human sensor when automatic operation is selected, or continuous operation for operating at specified flow rate when continuous operation is selected. Hence, ventilation is not interrupted by the usual manipulation by the user and ordinary ventilation operation can be conducted securely.

In the ventilator of the invention, the ventilator is installed in one space including bathroom and toilet, and the human sensor is disposed opposite to the suction louver provided at the suction port of the ventilator. Further, a detection defining unit is provided for defining the detection range of the human sensor, and a specified status of use by the user can be detected, and appropriate ventilation flow rate and ventilation time can be presented.

In the ventilator of the invention, the suction louver is rotatably installed. Hence, the detection range can be set freely regardless of condition of installation. Further, the user can freely set a desired detection range.

In the ventilator of the invention, the control unit, receiving a signal from the human sensor, measures the user staying time in the room, and varies the ventilation delay operation time after the user leaves the room on the basis of the cumulative time. That is, an effective ventilation is possible by delay operation time suited to the condition by judging the status of use of the toilet or bathroom by the user. As explained above, the delay operation is intended to exhaust the moisture in the bathroom or odor in the toilet by force after the user leaves the room. The delay operation time is the duration of time of such delay operation.

In the ventilator of the invention, the control unit, receiving a signal from the human sensor, measures the user staying time, and controls the ventilation flow rate in the user staying state on the basis of the cumulative time. Hence, proper ventilation operation depending on the condition of use can be presented, such as short and high flow rate operation for quick ventilation in toilet using state, or regulated flow rate operation for avoiding cold draft while bathing.

In the ventilator of the invention, the control unit, receiving a signal from the human sensor, measures the user staying time, and controls the ventilation flow rate during ventilation delay operation after the user leaves on the basis of the cumulative time. For example, if the human detection cumulative time is more than specified, fast ventilation operation can be presented for exhausting the high moisture state after bathing quickly and in a short time.

DETAILED DESCRIPTION OF THE PREFERRED EMBODIMENTS

Figure 1:
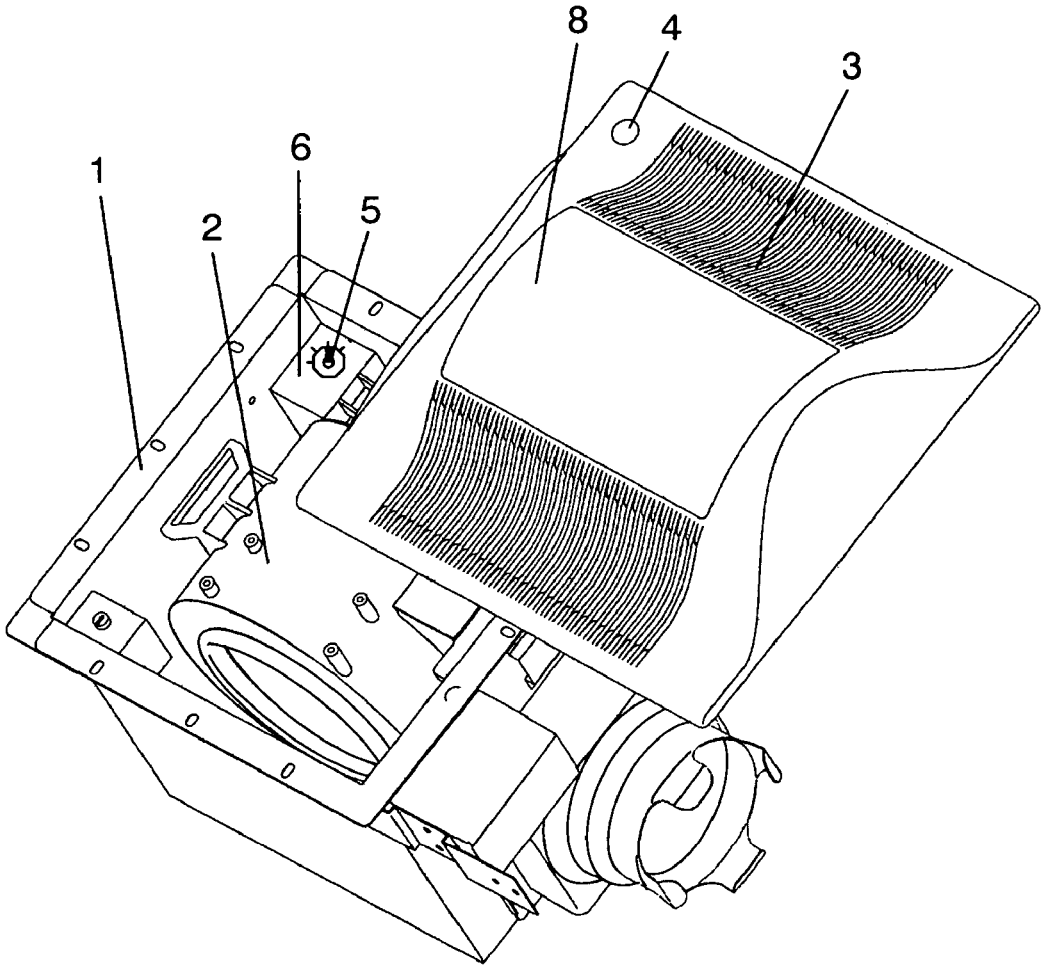
FIG. 1 is a perspective view of configuration of ventilator in a preferred embodiment of the invention.

A preferred embodiment of the invention is described below while referring to FIG. 1 to FIG. 5.

The ventilator of the invention comprises a ventilator main body 1, an exhaust fan motor 2 for exhausting room air by force, and a human sensor 4 for detecting the presence of human body. It further comprises a control unit 6 for controlling the fan motor 2 by receiving a signal from the human sensor 4, and a flow rate adjusting unit 5 for adjusting the ventilation flow rate by the exhaust fan motor 2. The control unit 6, when detecting a signal from the human sensor 4, operates the exhaust fan motor 2 for a specified time at fixed flow rate. While not detecting signal from the human sensor 4, it operates the exhaust fan motor 2 all the time at ventilated flow rate adjusted by the flow rate adjusting unit 5. During this ordinary operation, the flow rate may be adjusted by the flow rate adjusting unit 5 either steplessly or in multiple steps at small intervals.

Herein, by "steplessly," it means to set the flow rate freely in a range of upper limit and lower limit of specified flow rate. By "in multiple steps," it means to select the specified flow rate in plural stages in a range of upper limit and lower limit of specified flow rate.

Figure 2:
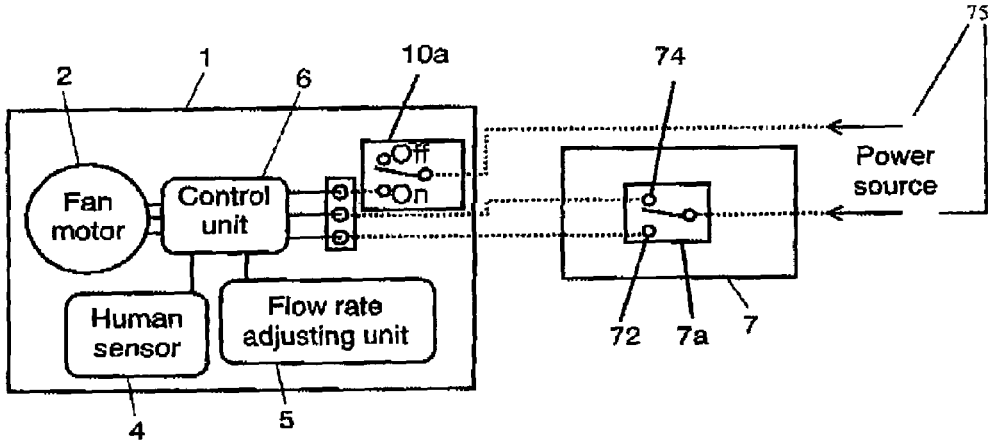
FIG. 2 is a schematic wiring diagram of configuration of the ventilator.

Specifically, the ventilator main body 1 shown in FIG. 1 and FIG. 2 is built in the ceiling of, for example, bathroom or toilet, and its discharge port (not shown) is disposed so as to communicate with outdoors through a duct (not shown). Inside the ventilator main body 1, the exhaust fan motor 2 is incorporated together with the control unit 6 for feeding power and controlling the exhaust fan motor 2. A suction louver 3 provided at a suction port communicating with the discharge port trough the fan, the human sensor 4 installed in the suction louver 3, and the flow rate adjusting unit 5 for adjusting the flow rate of the exhaust fan motor 2 from 100% to 30% are disposed at positions opposite from beneath the suction louver 3.

Separately from the ventilator main body 1, a wall switch 7 for selecting either automatic operation or continuous operation, not capable of cutting off the power, is built in the room wall. A power supply wire 75 is connected to the wall switch 7, but power switch is not provided in the wall switch 7, and it includes a selector 7*a* consisting of automatic operation mode operating unit 72 for automatically changing the flow rate by the human sensor 4, and a continuous operation mode operating unit 74 for feeding power continuously to the exhaust fan motor 2 by force at specified flow rate. A power switch 10*a* is provided in the ventilator main body 1 for turning on or off the power supply, or may be provided in the wall switch 7 for turning on or off the power supply between the power supply wire 75 and the selector 7*a*, so that it cannot be operated easily from outside of the room in which the ventilator main body is installed.

The flow rate adjusting unit 5 sets the flow rate in two modes, that is, flow rate A of maximum flow rate of exhaust fan motor 2, and flow rate B adjusted in flow rate steplessly or in multiple steps at small intervals. The flow rate is set by adjusting knob, not shown, provided in the flow rate adjusting unit 5.

Beneath the suction louver 3, a detection defining unit 8 is provided for cutting off the detection range of human sensor 4 in a specific direction only. The suction louver 3 is disposed rotatably in the ventilator main body 1. The detection defining unit 8 is projected to the lower side of the suction louver 3, and cuts off part of infrared ray or signal entering the human sensor 4. The human sensor 4 is formed on the surface of the suction louver 3, at an end remote from the forming position of the detection defining unit 8.

The control unit 6 has an arithmetic function of calculating the cumulative time T of the total time of detection of presence of human body. The control unit 6 also has a function of storing preset time T1 for judging either use of toilet or use of bathroom, and first delay time t1 and second delay time t2 for delay operation of exhaust fan motor 2 after the user leaves the toilet or bathroom.

Herein, the preset time T1 is set as the threshold for judging the toilet time and bathing time. According to statistic data of actual time of use, the preset time T1 is set at, for example, 5 minutes. The first delay time t1 is, for example, 15 minutes in the case of toilet or bathroom space of 25 cubic meters (measuring W (width)×L (length)×H (height)=2 m×5 m×2.5 m), and supposing the maximum flow rate of the ventilator to be 100 cubic meters per hour, because it takes 15 minutes for one complete ventilation. The second delay time t2 is the time obtained from the experiment of measuring the time required when the moisture is reduced from 100% dew condensation state right after using the bathroom to about 90% by ventilation, and it is set at 2 hours in the preferred embodiment.

In this configuration, when the feed rate B is set as optimum flow rate among multiple steps of flow rate at the desired flow rate of ordinary ventilation by the flow rate adjusting unit 5 so as to achieve a specified flow rate after installation of the ventilator, and then the user sets the wall switch 7 in the automatic operation mode 72, the control unit 6 reads the signal from the human sensor 4, and judges the presence of human body.

Figure 3:
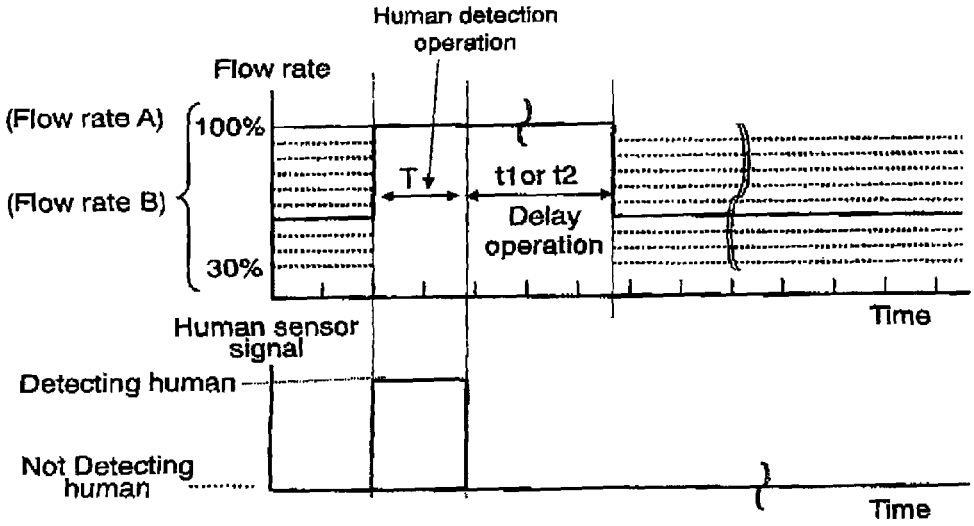
FIG. 3 is a time chart of automatic operation of the ventilator.

FIG. 3 is a chart of automatic operation of the ventilator of the invention. In FIG. 3, the axis of ordinates shows the flow rate of ventilator and the detection state by the human sensor 4, and the axis of abscissas denotes the operation time of the ventilator and the detection time by the human sensor 4.

As shown in FIG. 3, when the human sensor 4 does not judge presence of human body in the room and does not give detection signal, the control unit 6 operates at flow rate B adjusted by the flow rate adjusting unit 5 as the optimum flow rate between 30% and 100%. When the user enters the room and the human sensor detects the human presence, it is immediately changed over to the prefixed flow rate A (100%), and human detection operation starts. When the user leaves the room after time T and the human sensor 4 no longer detects human presence, delay operation is conducted at flow rate A for the duration of t1 or t2.

Figure 4:
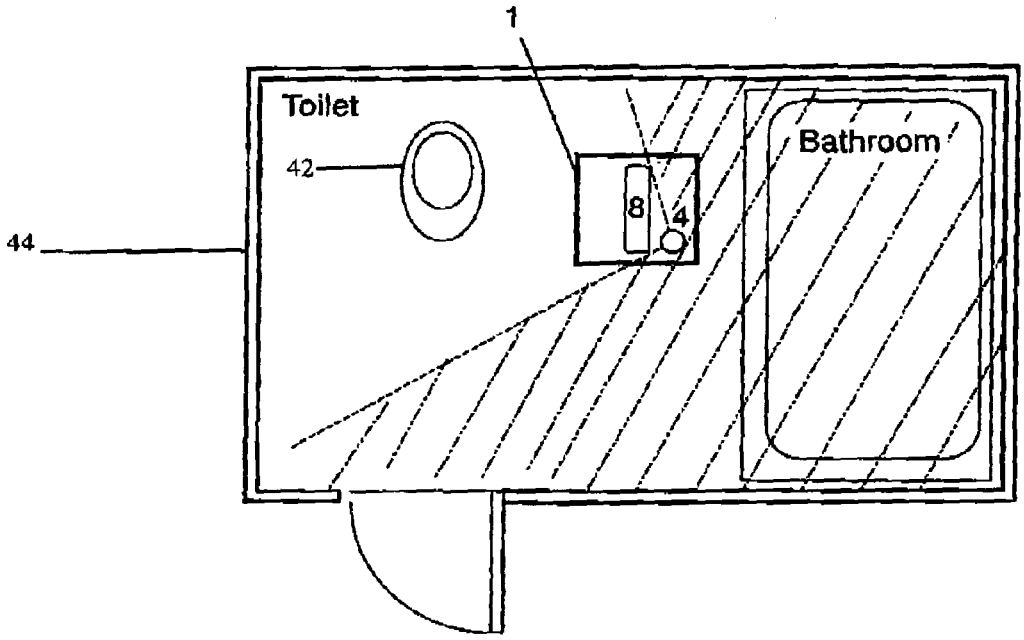
FIG. 4 is a plan view of installation site of the ventilator.

FIG. 4 is a plan view of bathroom and toilet at installation site of the ventilator of the invention. The ventilator main body 1 is built in the ceiling of toilet 42 and bathroom 44. The ventilator main body 1 includes the detection defining unit 8 and human sensor 4. The detection defining sensor 8 is installed at a position where the detection range of human sensor 4 covers a relatively wide range including the bathroom 44, but not reaching as far as the toilet 42. That is, the detection range is the shaded area in the drawing.

The reason of installation as shown in FIG. 4 is to distinguish the toilet using case and the bathroom using case so as to detect the state correctly. Hence, individually in the toilet using case and the bathroom using case, the flow rate is controlled and the delay operation time is adjusted properly, and ventilation can be operated properly depending on the status of use, such as exhaust of room odor when using the toilet or room moisture when using the bathroom.

The control unit 6 counts the time when the user enters the room, and easily judges whether the bathroom is used or not. It is judged that the bathroom is used when the human detection signal is relatively long, and that the toilet is used when it is as short as several minutes.

If the detection defining unit 8 cannot be provided beneath the suction louver 3, the control unit 6 can also judge the status of use by measuring the human presence time by the human sensor 4.

Figure 5:
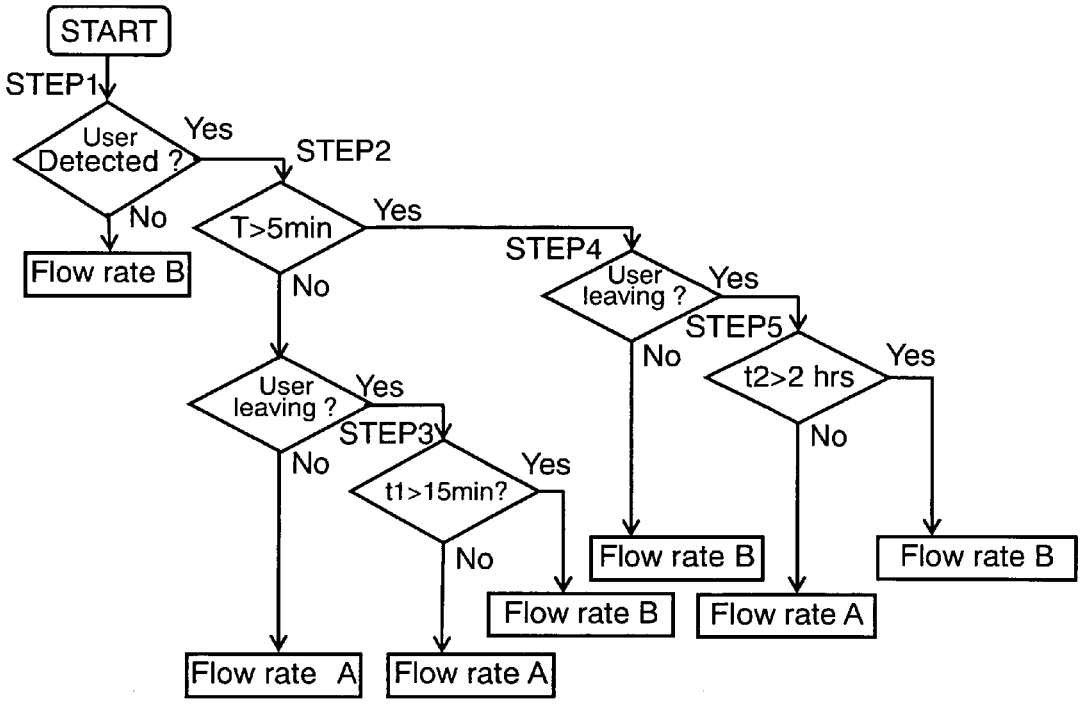
FIG. 5 is a flowchart of automatic operation of the ventilator.
Figure 6:
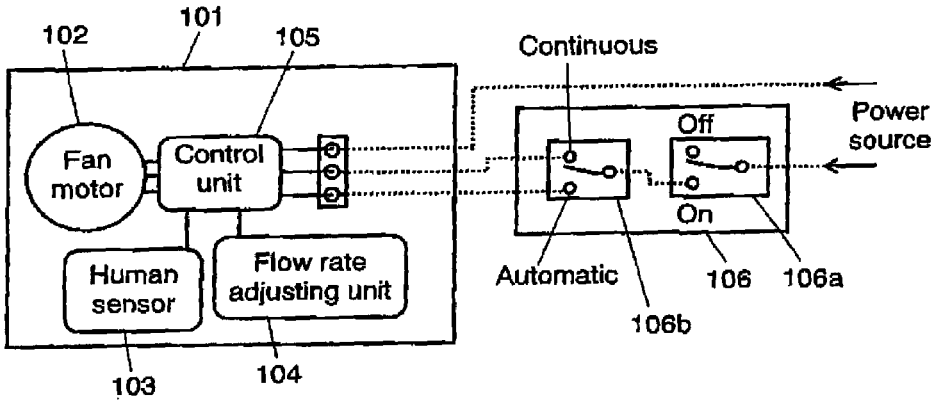
FIG. 6 PRIOR ART
FIG. 6 is a wiring diagram of a conventional ventilator.
Figure 7:
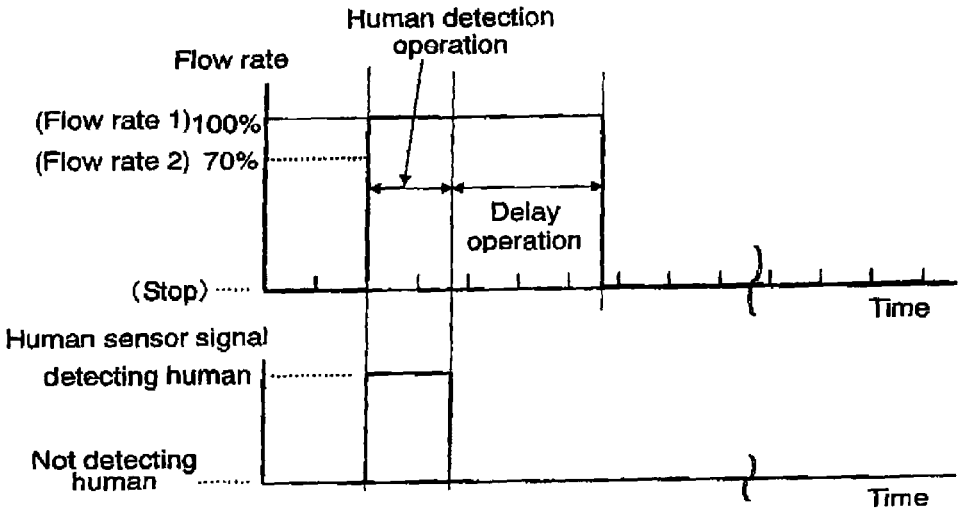
FIG. 7 PRIOR ART
FIG. 7 is a time chart of automatic operation of the conventional ventilator.

FIG. 5 is a flowchart of automatic operation of the ventilator of the invention. Referring to FIG. 5, the specific operation until the control unit 6 determines the flow rate by the human sensor 4 is explained below.

When the automatic operation of the ventilator starts, at step 1, the human sensor 4 detects for human presence. When human presence is not detected (No at step 1), the operation is conducted at flow rate B selected as ordinary ventilation flow rate. On the other hand, when human presence is detected (Yes at step 1), the signal detecting human presence by the human sensor 4 is fed into the control unit 6, and the process goes to step 2.

At step 2, the control unit 6 counts the human presence time in the toilet or bathroom, and determines the cumulative time T. Judging if the cumulative time T is over, for example, 5 minutes or not, when the cumulative time T is less than 5 minutes, for example, it is judged that the toilet is used. While the user is present in the room, the operation continues at fixed flow rate A. At this time, when the flow rate A is set at the maximum flow rate, a rapid ventilating effect is obtained.

When it is judged that the user leaves the room, the process goes to step 3. At step 3, the control unit 6 controls to start delay operation at flow rate A for t1=15 minutes from the moment of the user leaving the room, and then change over to flow rate B of ordinary ventilation flow rate.

At step 2, if the user stays in the room for more than 5 minutes, the process goes to step 4. At step 4, the control unit 6 judges the use of bathroom, and changes over to flow rate B adjusted as ordinary ventilation flow rate until the user leaves the room in order to lessen the feel of cold draft (No at step 4). As explained earlier, cold draft is feeling of uncomfortable coldness by the user in the bathroom due to invading air by ventilation or air stream caused by ventilation.

Then the process goes to step 5. At step 5, for less than the lapse of t2=2 hours after the user leaves the room, delay operation continues at flow rate A (No at step 5), and when t2 exceeds 2 hours, it is changed over to flow rate B of ordinary ventilation flow rate (Yes at step 5).

In this automatic operation of the invention, while keeping the ventilation flow rate of minimum required limit, delay operation is conducted for specified time at optimum flow rate depending on the state of use of the toilet or bathroom by the user, and therefore power consumption is saved, and an efficient ventilation is realized.

In the preferred embodiment, the ventilator is built in the ceiling of the room, but the same action and effect are obtained in the ventilator of wall mount type.

In the preferred embodiment, the preset time T1 is set at 5 minutes, t1 at 15 minutes, and t2 at 2 hours. However, the time may be set appropriately depending on the bathing time, space ventilation time, and ventilation time required to lower the moisture in consideration of the building materials.

Thus, according to the invention, the control unit 6 operates the exhaust fan motor 2 for specified time at fixed flow rate when receiving detection signal from the human sensor 4. When not detecting, the exhaust fan motor 2 is operated usually at ventilation flow rate adjusted by the flow rate adjusting unit 5. Since the ventilation flow rate during ordinary operation can be adjusted by the flow rate adjusting unit 5 steplessly or in multiple steps at small intervals, an appropriate ventilation flow rate can be selected depending on the environment of use, and efficient ventilation is possible all the time. At the same time, the ventilator capable of purifying and ventilating the room air temporarily is also presented. As exhaust fan motor 2, since a direct-current motor is used, the flow rate in ordinary ventilation can be set at optimum state suited to the condition of use.

The wall switch 7 does not have power switch, but includes a selector for selecting between automatic operation mode for automatically changing the ventilation flow rate by detection of the human sensor 4, and continuous operation mode for operating the exhaust fan motor 2 continuously by force at specified ventilation flow rate. Accordingly, the user can select either operation mode, and even in the environment of use where the user selects the continuous operation mode more often than the automatic operation mode, the ventilation is not interrupted, and the ventilator operating ordinary ventilation by priority can be presented.

The human sensor 4 is disposed oppositely to the suction louver 3 provided at the suction port of the ventilator installed in one space including the bathroom and toilet, and the detection defining unit 8 for defining the detection range of the human sensor 4 is provided. Accordingly, the non-detecting position of human sensor 4 can be easily set in the room, and the ventilator capable of selecting control of ventilation operation suited to the environment of use can be presented.

Since the suction louver 3 is rotatably installed, the ventilator allowing the user to set the human sensor easily in a desired detecting range can be presented.

The control unit 6, when receiving a signal from the human sensor 4, measures the human presence time, and varies the operation time of delay ventilation after the user leaves on the basis of the cumulative time, so that delay operation of appropriate ventilation depending on the status of use of toilet or bathroom is realized.

The control unit 6, when receiving a signal from the human sensor 4, measures the human presence time, and controls the ventilation flow rate in the human presence state on the basis of the cumulative time, thereby preventing excessive ventilation state or insufficient ventilation state.

The control unit 6, when receiving a signal from the human sensor 4, measures the human presence time, and controls the ventilation flow rate during ventilation delay operation after the user leaves on the basis of the cumulative time, so that delay flow rate of optimum ventilation is realized.

INDUSTRIAL APPLICABILITY

The ventilator of the invention can adjust the ventilation flow rate in ordinary ventilation operation appropriately. When detecting human presence, operation is conducted at appropriate flow rate and for an appropriate time depending on the status of use of toilet or bathroom, and while saving waste of power and ventilating by saving energy, operation is done at necessary ventilation flow rate, and it is useful when installed in a space people enter or leave frequently such as dining room or living room, not limited to toilet or bathroom, and its industrial applicability is very high.

The invention claimed is:

1. A ventilator comprising:

an exhaust fan motor, which is a direct-current motor, for ventilating room air, a human sensor for detecting the presence of a human body, a control unit for controlling the exhaust fan motor by receiving a signal from the human sensor, and an air flow rate adjusting unit for adjusting the ventilation flow rate by the exhaust fan motor, wherein the control unit operates the ventilation fan motor at a fixed flow rate for a specified time when detecting a signal from the human sensor indicative of the presence of a human body, and operates the ventilation fan motor at a ventilation flow rate adjusted by the flow rate adjusting unit all the time as ordinary operation when not detecting the signal, and in the ordinary operation, the ventilation flow rate can be adjusted steplessly or in multiple steps at small intervals by the flow rate adjusting unit, wherein the control unit, when receiving a signal from the human sensor, measures a user staying time, and varies a ventilation delay operation time after a user leaves the room on the basis of a cumulative time calculated from the user staying time, and wherein the control unit, when receiving a signal from the human sensor, measures a user staying time, and controls the ventilation flow rate during ventilation delay operation after a user leaves on the basis of a cumulative time calculated from the user staying time.

2. The ventilator of claim 1, wherein the fixed flow rate operated by a signal from the human sensor is the maximum flow rate of the exhaust fan motor.

3. The ventilator of claim 1, further comprising a wall switch configured to be built in a wall, and the wall switch not including a power switch which interrupts ventilation, the wall switch including a selector for selecting between automatic operation mode for automatically changing the ventilation flow rate by detection of the human sensor, and continuous operation mode for operating the exhaust fan motor continuously by force at specified ventilation flow rate, wherein either operation mode can be selected without turning on or off power supply by the power switch.

4. The ventilator of claim 1, wherein the ventilator is installed in one space including bathroom or toilet, and the human sensor is disposed adjacent to a suction louver provided at a suction port of the ventilator, and also a detection defining unit is provided for defining a detection range of the human sensor.

5. The ventilator of claim 4, wherein the suction louver is rotatably installed to adjust the detection range of the human sensor.

6. The ventilator of claim 1, wherein the control unit, when receiving a signal from the human sensor, measures a user staying time, and controls the ventilation flow rate in the user staying state on the basis of a cumulative time calculated from the user staying time.

* * * * *